US009284902B2

(12) United States Patent
Keller et al.

(10) Patent No.: US 9,284,902 B2
(45) Date of Patent: Mar. 15, 2016

(54) ENGINE CONTROL SYSTEMS AND METHODS FOR ACCELERATOR PEDAL TIP-OUT

(71) Applicant: GM Global Technology Operations LLC, Detroit, MI (US)

(72) Inventors: Bret J. Keller, Livonia, MI (US); Krishnendu Kar, South Lyon, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 182 days.

(21) Appl. No.: 13/968,706

(22) Filed: Aug. 16, 2013

(65) Prior Publication Data

US 2015/0051808 A1 Feb. 19, 2015

(51) Int. Cl.

| | |
|---|---|
| ***F02D 13/00*** | (2006.01) |
| ***F02D 41/02*** | (2006.01) |
| ***F02D 28/00*** | (2006.01) |
| ***F02D 41/12*** | (2006.01) |
| ***F02D 37/02*** | (2006.01) |
| *F02D 41/00* | (2006.01) |
| *F02D 13/02* | (2006.01) |

(52) U.S. Cl.

CPC ..... *F02D 41/0215* (2013.01); *F02D 13/00* (2013.01); *F02D 28/00* (2013.01); *F02D 37/02* (2013.01); *F02D 41/12* (2013.01); *F02D 13/0219* (2013.01); *F02D 41/0007* (2013.01); *F02D 41/0087* (2013.01); *F02D 2041/001* (2013.01); *F02D 2250/21* (2013.01)

(58) Field of Classification Search

CPC . F02D 41/0215; F02D 2250/21; F02D 13/00; B60W 10/02

USPC ..... 701/102, 54, 51, 110

See application file for complete search history.

(56) References Cited

U.S. PATENT DOCUMENTS

| | | | |
|---|---|---|---|
| 7,058,502 | B2 | 6/2006 | Rodgers |
| 7,577,507 | B2 | 8/2009 | Morris |
| 8,397,694 | B2 | 3/2013 | Whitney et al. |
| 2002/0107626 | A1 * | 8/2002 | Graf ..... 701/54 |
| 2002/0129788 | A1 | 9/2002 | O'Neil et al. |
| 2005/0016162 | A1 | 1/2005 | Mehta et al. |
| 2005/0137059 | A1 | 6/2005 | Takahashi |
| 2007/0225888 | A1 | 9/2007 | Morris |
| 2009/0056672 | A1 | 3/2009 | Whitney et al. |
| 2009/0101101 | A1 | 4/2009 | Iwamoto |

(Continued)

FOREIGN PATENT DOCUMENTS

| | | | |
|---|---|---|---|
| CN | 101042183 | A | 9/2007 |
| CN | 101377156 | A | 3/2009 |

OTHER PUBLICATIONS

U.S. Appl. No. 13/605,270, filed Sep. 6, 2012, Kar et al.

*Primary Examiner* — Mahmoud Gimie

(57) ABSTRACT

A difference module determines a difference between an engine speed and a transmission input shaft speed. A state control module sets a signal to a first state when a driver releases an accelerator pedal and selectively transitions the signal from the first state to a second state when the difference is less than zero. An immediate torque request module decreases an engine torque request when the signal is in the first state and selectively increases the engine torque request when the signal is in the second state. At least one of: a spark control module that selectively adjusts spark timing based on the engine torque request; and a fuel control module that selectively adjusts fueling based on the engine torque request.

20 Claims, 6 Drawing Sheets

(56) References Cited

U.S. PATENT DOCUMENTS

| | | | | |
|---|---|---|---|---|
| 2010/0105523 | A1* | 4/2010 | Hrovat et al. | 477/175 |
| 2011/0112734 | A1* | 5/2011 | Whitney et al. | 701/54 |
| 2011/0168117 | A1 | 7/2011 | Bolander et al. | |
| 2011/0238280 | A1 | 9/2011 | Shibata et al. | |
| 2011/0276256 | A1* | 11/2011 | Kociba et al. | 701/110 |
| 2012/0078486 | A1 | 3/2012 | Welschof et al. | |
| 2012/0145123 | A1 | 6/2012 | Ono | |
| 2012/0180759 | A1 | 7/2012 | Whitney et al. | |
| 2012/0247411 | A1 | 10/2012 | Stewart et al. | |

* cited by examiner

ENGINE CONTROL SYSTEMS AND METHODS FOR ACCELERATOR PEDAL TIP-OUT

FIELD

The present disclosure relates to internal combustion engines and more particularly to systems and methods for controlling an engine after a driver releases an accelerator pedal.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Airflow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. Increasing the air and fuel to the cylinders increases the torque output of the engine.

Engine control systems have been developed to control engine torque output to achieve a desired predicted torque. Traditional engine control systems, however, do not control the engine torque output as accurately as desired. Further, traditional engine control systems do not provide as rapid of a response to control signals as is desired or coordinate engine torque control among various devices that affect engine torque output.

SUMMARY

In a feature, a difference module determines a difference between an engine speed and a transmission input shaft speed. A state control module sets a signal to a first state when a driver releases an accelerator pedal and selectively transitions the signal from the first state to a second state when the difference is less than zero. An immediate torque request module decreases an engine torque request when the signal is in the first state and selectively increases the engine torque request when the signal is in the second state. At least one of: a spark control module that selectively adjusts spark timing based on the engine torque request; and a fuel control module that selectively adjusts fueling based on the engine torque request.

In further features, the difference module sets the difference equal to the engine speed minus the transmission input shaft speed.

In still further features, at least one of: the spark control module advances the spark timing when the engine torque request increases; and the fuel control module increases fueling when the engine torque request increases.

In yet further features, the state control module transitions the signal from the second state to a third state a predetermined period after transitioning the signal to the second state. The immediate torque request module decreases the engine torque request when the signal is in the third state.

In further features, the immediate torque request module decreases the engine torque request exponentially when the signal is in the third state.

In still further features, the immediate torque request module decreases the engine torque request at a first rate when the signal is in the first state and decreases the engine torque request at a second rate when the signal is in the third state.

In yet further features, an increasing module that determines an increased torque request based on a gear ratio and a target engine speed, and the immediate torque request module sets the engine torque request to the increased torque request when the signal is in the second state.

In further features, the increasing module determines a base torque based on the gear ratio and the target engine speed, determines a delta torque based on the gear ratio and a difference between the target engine speed and the engine speed, and determines the increased torque request based on the base torque and the delta torque.

In still further features, the increasing module sets the increased torque equal to the base torque plus the delta torque.

In yet further features, the state control module selectively transitions the signal from the first state to a second state when the difference is less than a predetermined speed that is less than zero.

In a feature, an engine control method includes: determining a difference between an engine speed and a transmission input shaft speed; setting a signal to a first state when a driver releases an accelerator pedal; selectively transitioning the signal from the first state to a second state when the difference is less than zero; decreasing an engine torque request when the signal is in the first state; selectively increasing the engine torque request when the signal is in the second state; and at least one of: selectively adjusting spark timing based on the engine torque request; and selectively adjusting fueling based on the engine torque request.

In further features, the engine control method further includes setting the difference equal to the engine speed minus the transmission input shaft speed.

In still further features, the engine control method further includes at least one of: advancing the spark timing when the engine torque request increases; and increasing fueling when the engine torque request increases.

In yet further features, the engine control method further includes: transitioning the signal from the second state to a third state a predetermined period after transitioning the signal to the second state; and decreasing the engine torque request when the signal is in the third state In further features, the engine control method further includes decreasing the engine torque request exponentially when the signal is in the third state.

In still further features, the engine control method further includes: decreasing the engine torque request at a first rate when the signal is in the first state; and decreasing the engine torque request at a second rate when the signal is in the third state.

In still further features, the engine control method further includes: determining an increased torque request based on a gear ratio and a target engine speed; and setting the engine torque request to the increased torque request when the signal is in the second state.

In still further features, the engine control method further includes: determining a base torque based on the gear ratio and the target engine speed; determining a delta torque based on the gear ratio and a difference between the target engine speed and the engine speed; and determining the increased torque request based on the base torque and the delta torque.

In yet further features, the engine control method further includes setting the increased torque equal to the base torque plus the delta torque.

In further features, the engine control method further includes selectively transitioning the signal from the first state to a second state when the difference is less than a predetermined speed that is less than zero.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A control module of a vehicle controls torque output of an engine based on driver inputs, such as a position of an accelerator pedal. More specifically, the control module generates engine torque requests based on the driver inputs and controls engine actuators based on the engine torque requests. A transmission transfers torque from the engine to a driveline, and the driveline transfers torque to wheels of the vehicle.

The control module generally decreases the engine torque requests when the driver releases the accelerator pedal. Decreasing the engine torque requests decreases the torque output of the engine. When the driver releases the accelerator pedal, however, torque attributable to the vehicle's momentum is fed back to the engine via the driveline and the transmission. This torque may cause teeth of one or more sets of meshed gears to contact each other and produce sound and/or vibration.

To minimize or prevent sound and vibration from occurring after the driver releases the accelerator pedal, the control module of the present disclosure selectively increases an engine torque request when an engine speed is less than a transmission input shaft speed. The engine speed being less than the transmission input shaft speed indicates that sound and/or vibration may occur.

Increasing the engine torque requests increases the torque output of the engine and, therefore, increases the engine speed toward the transmission input shaft speed. Increasing the engine speed toward the transmission input shaft speed may minimize any sound and vibration that occurs when the teeth of the one or more sets of meshed gears contact each other.

Increasing the engine torque request to minimize sound and vibration may also enable the control module to rapidly decrease the engine torque request after the increase. The control module may, for example, decrease the engine torque request exponentially after increasing the engine torque request. Rapidly decreasing the engine torque request may enable one or more fuel consumption decreasing actions (e.g., fuel cutoff, deceleration fuel cutoff, and/or cylinder deactivation) to be taken as early as possible after the release of the accelerator pedal.

Figure 1:
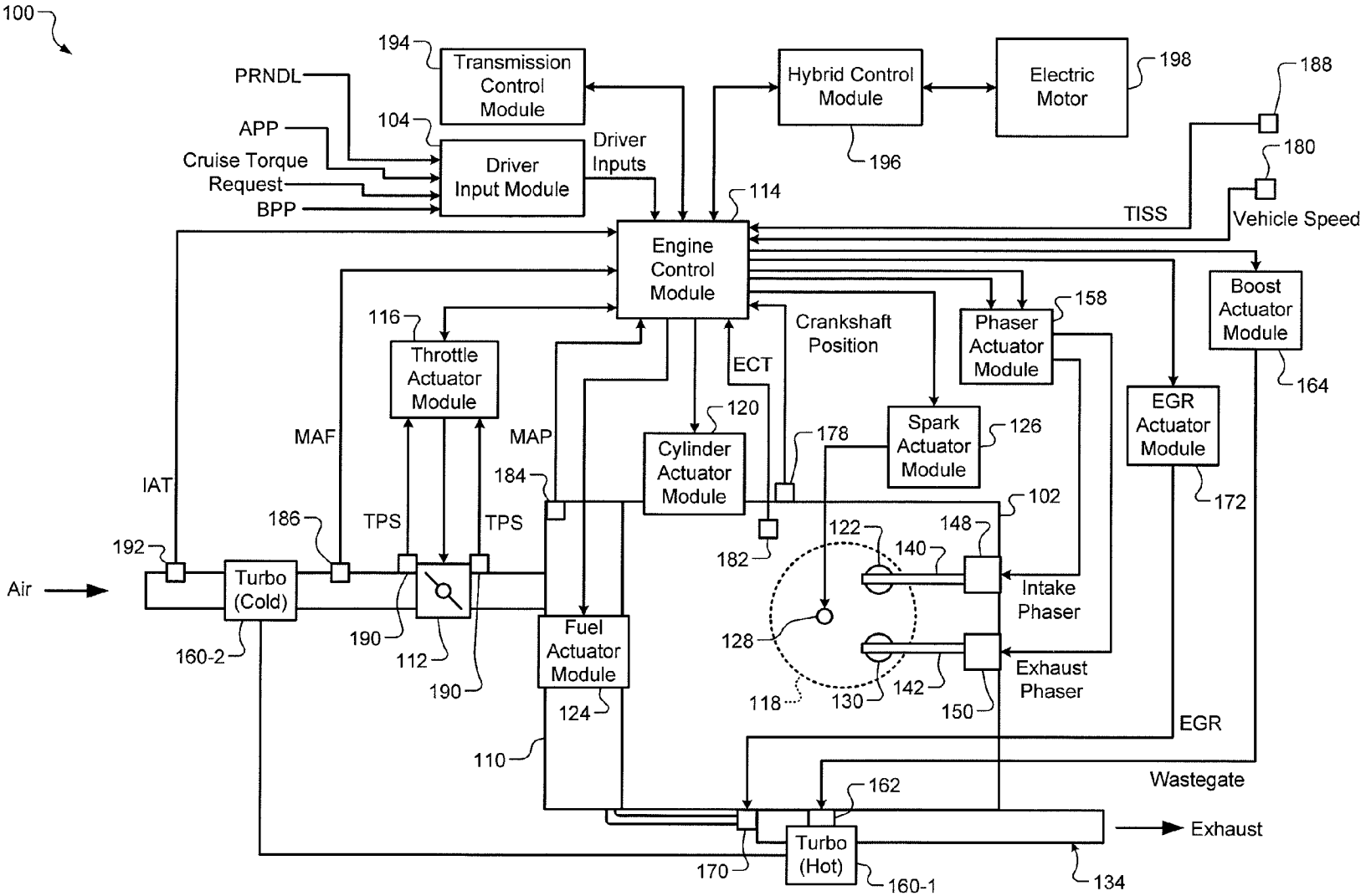
FIG. 1 is a functional block diagram of an example implementation of an engine system according to the present disclosure.

Referring now to FIG. 1, a functional block diagram of an example engine system 100 is presented. The engine system 100 includes an engine 102 that combusts an air/fuel mixture to produce drive torque for a vehicle based on driver inputs from a driver input module 104. The driver inputs may include, for example, one or more accelerator pedal positions (APPs) measured by APP sensors (not shown), one or more brake pedal positions (BPPs) measured by BPP sensors (not shown), and a cruise torque request provided by a cruise control system (not shown). In various implementations, the cruise control system may include an adaptive cruise control system that maintains a predetermined following distance. The driver inputs may also include a position of a park, reverse, neutral, drive lever (PRNDL) and other suitable inputs.

Air is drawn into an intake manifold 110 through a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control the amount of air drawn into the intake manifold 110.

Air from the intake manifold 110 is drawn into one or more cylinders of the engine 102. While the engine 102 may include more than one cylinder, for illustration purposes only a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate (valves of) some or all of the cylinders, for example, to improve fuel efficiency in some circumstances.

The engine 102 may operate using a four-stroke engine cycle. The four strokes, described below, may be referred to as the intake stroke, the compression stroke, the combustion stroke, and the exhaust stroke. During each revolution of a crankshaft (not shown), two of the four strokes occur within the cylinder 118. Therefore, two crankshaft revolutions may be necessary for the cylinder 118 to experience all four of the strokes of one engine cycle.

During the intake stroke, air from the intake manifold 110 is drawn into the cylinder 118 through an intake valve 122. The ECM 114 controls a fuel actuator module 124, which regulates fuel injection to achieve a target air/fuel ratio. Fuel may be injected into the intake manifold 110 at a central location or at multiple locations, such as near the intake valve(s) of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture. During the compression stroke, a piston (not shown) within the cylinder 118 compresses the air/fuel mixture. Based on a signal from the ECM 114, a spark actuator module 126 energizes a spark plug 128 in the cylinder 118, which ignites the air/fuel mixture. The timing of the spark may be specified relative to the time when the piston is at a topmost position, referred to as top dead center (TDC).

The spark actuator module 126 may be controlled by a timing signal specifying how far before or after TDC to generate the spark. Because the piston position is directly related to crankshaft rotation, operation of the spark actuator module 126 may be synchronized with crankshaft angle. In various implementations, the spark actuator module 126 may halt provision of spark to deactivated cylinders. While a spark ignition engine, the present disclosure is also applicable to other types of engines including compression combustion engines and other types of engines.

Combustion of the air/fuel mixture within a cylinder may be referred to as a firing event. The spark actuator module 126 may have the ability to vary the timing of the spark for each firing event. In addition, the spark actuator module 126 may have the ability to vary the spark timing for a given firing event even when a change in the timing signal is received after a firing event of a cylinder immediately before a given firing event.

During the combustion stroke, the combustion of the air/fuel mixture drives the piston away from the TDC position, thereby driving the rotation of the crankshaft. The combustion stroke may be defined as the time between the piston reaching TDC and the time at which the piston reaches a bottommost position, which may be referred to as bottom dead center (BDC). During the exhaust stroke, the piston moves toward the TDC position again and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may disable opening of the intake valve 122 and/or the exhaust valve 130 of deactivated cylinders. In various other implementations, the intake valve 122 and/or the exhaust valve 130 may be controlled by devices other than camshafts, such as electromagnetic actuators.

The time at which the intake valve 122 is opened may be varied with respect to the TDC position by an intake cam phaser 148. The time at which the exhaust valve 130 is opened may be varied with respect to the TDC position by an exhaust cam phaser 150. A phaser actuator module 158 may control the intake cam phaser 148 and the exhaust cam phaser 150 based on signals from the ECM 114. When implemented, variable valve actuation (WA) technologies (not shown) may also be controlled by the phaser actuator module 158.

The engine system 100 may include a boost device that provides pressurized air to the intake manifold 110. For example, FIG. 1 shows a turbocharger including a turbine 160-1 that is powered by hot exhaust gases flowing through the exhaust system 134. The turbocharger also includes a cold air compressor 160-2, driven by the turbine 160-1, that compresses air leading into the throttle valve 112. In various implementations, a supercharger (not shown), driven by the crankshaft, may compress air from the throttle valve 112 and deliver compressed air to the intake manifold 110.

A wastegate 162 (e.g., a turbo bypass valve) may allow exhaust to bypass the turbine 160-1, thereby reducing the boost provided by the turbocharger. The ECM 114 may control the boost of the turbocharger via a boost actuator module 164. For example only, the boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

A cooler (e.g., an intercooler or a charge air cooler) (not shown) may dissipate some of the heat contained in the compressed air charge, which is generated as the air is compressed. The compressed air charge may also absorb heat from components of the exhaust system 134. Although shown separated for purposes of illustration, the turbine 160-1 and the compressor 160-2 may be attached to each other near the location of the turbine 160-1, placing intake air in close proximity to hot exhaust.

The engine system 100 may include an exhaust gas recirculation (EGR) valve 170 that selectively directs exhaust gas back to the intake manifold 110. The EGR valve 170 may be located upstream of the turbine 160-1. The EGR valve 170 may be controlled by an EGR actuator module 172.

A position of the crankshaft may be measured using a crankshaft position sensor 178. The ECM 114 may determine a rotational speed of the crankshaft in revolutions per minute (RPM) based on the crankshaft position. The rotational speed of the crankshaft may also be referred to as engine speed or engine output speed.

A vehicle speed sensor 180 may measure a speed of the vehicle. The vehicle speed may be determined based on, for example, a transmission output shaft speed (TOSS), one or more wheel speeds, or another suitable measure of the vehicle speed. Temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum may be measured, where engine vacuum includes a difference between ambient air pressure and the pressure within the intake manifold 110. Mass air flowrate into the intake manifold 110 may be measured using a mass air flowrate (MAF) sensor 186. In various implementations, the MAF sensor 186 may be located in a housing that also includes the throttle valve 112. A transmission input shaft speed (TISS) sensor 188 may measure a rotational speed of a transmission input shaft.

The throttle actuator module 116 may monitor the position of the throttle valve 112 using one or more throttle position sensors (TPS) 190. The temperature of air being drawn into the engine 102 may be measured using an intake air temperature (IAT) sensor 192. In various implementations, the IAT may be used as an ambient air temperature. The ECM 114 may use signals from the sensors to make control decisions for the engine system 100.

The ECM 114 may communicate with a transmission control module 194 to coordinate operation of the engine 102 with a transmission (not shown). For example only, the ECM 114 may reduce engine output torque for a gear shift within the transmission. Torque output by the engine 102 may be transferred to the transmission via one or more torque transmission devices (not shown), such as a torque converter.

The transmission control module 194 may also share data with the ECM 114, such as a gear ratio selected within the transmission and a commanded state of a torque converter clutch (TCC) (not shown) of the torque converter. For example only, the state of the TCC may include a locked state or an unlocked state. The state of the TCC may be related to an amount of TCC slip. TCC slip may refer to a difference between the engine speed and the transmission input shaft speed. The TCC may be said to be in the locked state when the TCC slip is approximately zero. The TCC may also be said to be in the locked state when the TCC slip is being controlled to less than a predetermined slip (e.g., 15 revolutions per minute). The TCC may be said to be in the unlocked state when the TCC slip is greater than the predetermined slip.

The ECM 114 may also communicate with a hybrid control module 196 to coordinate operation of the engine 102 and an electric motor 198. The electric motor 198 may also function as a generator, and may selectively be used to produce electrical energy for use by vehicle electrical systems and/or for storage in a battery. The electric motor 198 may also function as a starter to drive rotation of the crankshaft to startup the engine 102. The electric motor 198 may also function as a motor to supplement/assist the engine 102.

An engine actuator varies one or more engine parameters based on an associated target value. For example only, the throttle actuator module 116 may be referred to as an engine actuator and a target throttle opening may be the associated target value. In the example of FIG. 1, the throttle actuator module 116 achieves the target throttle opening by adjusting opening of the throttle valve 112.

Similarly, the spark actuator module 126 may be referred to as an engine actuator, while the associated target value may refer to a target amount of spark advance, for example, relative to cylinder TDC. Other engine actuators may include the cylinder actuator module 120, the fuel actuator module 124, the phaser actuator module 158, the boost actuator module 164, and the EGR actuator module 172. For these engine actuators, the associated target values may include number of activated cylinders, fueling rate, intake and exhaust cam phaser angles, boost pressure, and EGR valve opening, respectively. The ECM 114 may control the target values in order to cause the engine 102 to generate a desired engine output torque and to achieve one or more other targets.

Figure 2:
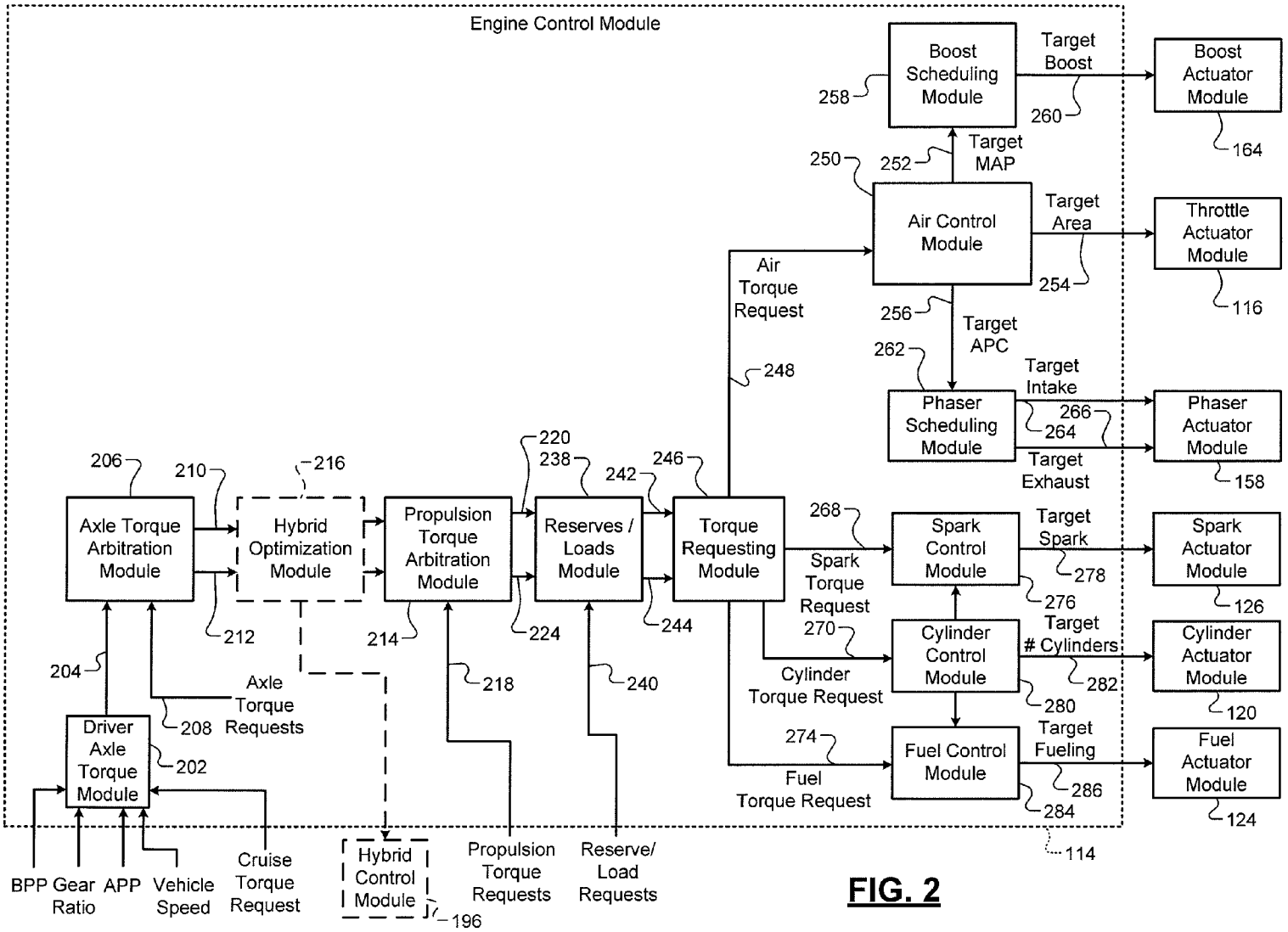
FIG. 2 is a functional block diagram of an example implementation of an engine control system according to the present disclosure.

Referring now to FIG. 2, a functional block diagram of an example engine control system is presented. An example implementation of the ECM 114 includes a driver axle torque module 202. The driver axle torque module 202 may determine a final driver axle request and predicted and immediate driver (axle) torque requests 204 as discussed below in conjunction with the examples of FIGS. 3 and 4.

An axle torque arbitration module 206 arbitrates between the driver axle torque requests 204 from the driver axle torque module 202 and other axle torque requests 208. The other axle torque requests 208 may include, for example, torque requests generated to decease positive or negative wheel slip and/or other types of axle torque requests. Axle torque (torque at the wheels) may be produced by various sources including the engine 102 and/or the electric motor 198.

The axle torque arbitration module 206 outputs a predicted (axle) torque request 210 and an immediate (axle) torque request 212 based on the results of arbitrating between the received torque requests. As described below, the predicted and immediate torque requests 210 and 212 may selectively be adjusted by other modules of the ECM 114 before being used to control the engine actuators.

In general terms, the immediate torque request 212 may be an amount of currently desired axle torque, while the predicted torque request 210 may be an amount of axle torque that may be needed on short notice. The ECM 114 controls the engine system 100 to produce an axle torque equal to the immediate torque request 212. However, different combinations of target values may result in production of the same amount of axle torque.

The ECM 114 may therefore adjust one or more target values to enable a faster transition to the predicted torque request 210, while still maintaining the axle torque at the immediate torque request 212. In various implementations, the predicted torque request 210 may be set based on one or more driver torque requests. The immediate torque request 212 may be set to less than the predicted torque request 210 under some circumstances.

In general terms, the difference between the immediate torque request 212 and the predicted torque request 210 can be referred to as a torque reserve. The torque reserve may represent the amount of additional torque (above the immediate torque request 212) that the engine system 100 can begin to produce with minimal delay. Fast engine actuators are used to increase or decrease current axle torque with minimal delay. Fast engine actuators are defined in contrast with slow engine actuators.

Generally speaking, fast engine actuators can change the engine torque output more quickly than slow engine actuators. Slow actuators may respond more slowly to changes in their respective target values than fast actuators do. For example, a slow actuator may include mechanical components that require time to move from one position to another in response to a change in target value. A slow actuator may also be characterized by the amount of time it takes for the engine torque to begin to change-once the slow actuator begins to implement the changed target value. Generally, this amount of time will be longer for slow actuators than for fast actuators. In addition, even after beginning to change, the engine torque may take longer to fully respond to a change in a slow actuator.

For example only, the spark actuator module 126 may be a fast actuator. Spark-ignition engines may combust fuels including, for example, gasoline and ethanol, by applying a spark. The fuel actuator module 124 may be a fast actuator in compression-ignition engines, such as diesel engines. By way of contrast, the throttle actuator module 116 may be a slow actuator.

As described above, the spark actuator module 126 can vary the spark timing for a next firing event when the spark timing is changed between a last firing event and the next firing event. By way of contrast, changes in throttle opening take longer to affect engine output torque. The throttle actuator module 116 changes the throttle opening by adjusting the angle of the blade of the throttle valve 112.

Therefore, when the target value for opening of the throttle valve 112 is changed, there is a mechanical delay as the throttle valve 112 moves from its previous position to a new position in response to the change. In addition, air flow changes based on the throttle opening are subject to air transport delays in the intake manifold 110. Further, increased air flow in the intake manifold 110 is not realized as an increase in engine output torque until the cylinder 118 receives additional air in the next intake stroke, compresses the additional air, and combustion including that additional air begins.

Using these actuators as an example, a torque reserve can be created by setting the throttle opening to a value that would allow the engine 102 to produce the predicted torque request 210. Meanwhile, the spark timing can be set based on the immediate torque request 212, which is less than the predicted torque request 210. Although the throttle opening generates enough air flow for the engine 102 to produce the predicted torque request 210, the spark timing is retarded (which reduces torque) based on the immediate torque request 212. The engine 102 will therefore produce the immediate torque request 212.

When additional torque is needed, the spark timing can be set based on the predicted torque request 210 or a torque between the predicted and immediate torque requests 210 and 212. By the following firing event, the spark actuator module 126 may return the spark timing to an optimum value, which allows the engine 102 to produce the full engine output torque achievable with the air flow already present. The engine output torque may therefore be quickly increased to achieve the predicted torque request 210 without experiencing delays from changing the throttle opening.

The axle torque arbitration module 206 may output the predicted torque request 210 and the immediate torque request 212 to a propulsion torque arbitration module 214. In various implementations, the axle torque arbitration module 206 may output the predicted and immediate torque requests 210 and 212 to a hybrid optimization module 216.

The hybrid optimization module 216 may determine how much torque should be produced by the engine 102 and how much torque should be produced by the electric motor 198. The hybrid optimization module 216 then outputs modified predicted and immediate torque requests (not numbered) to the propulsion torque arbitration module 214. In various implementations, the hybrid optimization module 216 may be implemented in the hybrid control module 196.

The predicted and immediate torque requests received by the propulsion torque arbitration module 214 are converted from an axle torque domain (torque at the wheels) into a propulsion torque domain (torque at the crankshaft). This conversion may occur before, after, as part of, or in place of the hybrid optimization module 216.

The propulsion torque arbitration module 214 arbitrates between received propulsion torque requests to generate an arbitrated predicted torque request 220 and an arbitrated immediate torque request 224. The arbitrated torque requests 220 and 224 may be generated by selecting a winning request from among received torque requests. Alternatively or additionally, the arbitrated torque requests may be generated by modifying one of the received requests based on another one or more of the received torque requests.

The received propulsion torque requests include the converted predicted and immediate torque requests and other propulsion torque requests. The received propulsion torque requests may also include other propulsion torque requests 218. For example, the propulsion torque requests 218 may include torque reductions for engine over-speed protection, torque increases for stall prevention, torque reductions requested by the transmission control module 194 to accommodate gear shifts, and other types of propulsion torque requests.

A reserves/loads module 238 receives the arbitrated predicted and immediate torque requests 220 and 224. Based on one or more reserve and/or torque load requests 240, the reserves/loads module 238 may adjust the arbitrated predicted and immediate torque requests 220 and 224 to create a torque reserve, to adjust a torque reserve already present in the arbitrated predicted and immediate torque requests 220 and 224, and/or to compensate for one or more torque loads on the engine 102. The reserves/loads module 238 outputs adjusted predicted and immediate torque requests 242 and 244 to a torque requesting module 246.

For example only, a catalyst light-off process or a cold start emissions reduction process may require retarded spark timing. The reserves/loads module 238 may therefore increase the adjusted predicted torque request 242 above the adjusted immediate torque request 244 to create retarded spark for the cold start emissions reduction process. In another example, the air/fuel ratio of the engine and/or the mass air flow may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The reserves/loads module 238 may also create or increase a torque reserve in anticipation of a future load, such as power steering pump operation or engagement of an air conditioning (A/C) compressor clutch. The reserve for engagement of the A/C compressor clutch may be created when the driver first requests air conditioning. The reserves/loads module 238 may increase the adjusted predicted torque request 242 while leaving the adjusted immediate torque request 244 unchanged to produce the torque reserve. Then, when the A/C compressor clutch engages, the reserves/loads module 238 may increase the adjusted immediate torque request 244 by the estimated load of the A/C compressor clutch.

The torque requesting module 246 receives the adjusted predicted and immediate torque requests 242 and 244. The torque requesting module 246 determines how the adjusted predicted and immediate torque requests 242 and 244 will be achieved. The torque requesting module 246 may be engine type specific. For example, the torque requesting module 246 may be implemented differently or use different control schemes for spark-ignition engines versus compression-ignition engines.

In various implementations, the torque requesting module 246 may define a boundary between modules that are common across all engine types and modules that are engine type specific. For example, engine types may include spark-ignition and compression-ignition and other suitable types of engines. Modules prior to the torque requesting module 246, such as the propulsion torque arbitration module 214, may be common across engine types, while the torque requesting module 246 and subsequent modules may be engine type specific.

The torque requesting module 246 determines an air torque request 248 based on the adjusted predicted and immediate torque requests 242 and 244. Target values for airflow controlling engine actuators are determined based on the air torque request 248. For example, based on the air torque request 248, an air control module 250 may determine a target MAP 252, a target throttle opening 254, and a target mass of air per cylinder (APC) 256.

A boost control module 258 may determine a target boost 260 based on the target MAP 252, and the boost actuator module 164 may control boost provided by the turbocharger based on the target boost 260. The throttle actuator module 116 may control opening of the throttle valve 112 based on the target throttle opening 254. A phaser scheduling module 262 may determine target intake and exhaust phase angles 264 and 266 based on the target APC 256, and the phaser actuator module 158 may control phasing of the intake and exhaust valves based on the target intake and exhaust phase angles 264 and 266. The air control module 250 may also determine one or more other target values for controlling one or more other airflow controlling engine actuators based on the air torque request 248, such as for the EGR valve 170.

The torque requesting module 246 may also generate a spark torque request 268, a cylinder torque request 270, and a fuel torque request 274 based on the predicted and immediate torque requests 242 and 244. A spark control module 276 may determine a target spark timing 278 based on the spark torque request 268. The spark actuator module 126 may provide spark based on the target spark timing 278.

The cylinder torque request 270 may be used by a cylinder control module 280 to determine a target number of cylinders to deactivate 282. In various implementations, a target number of cylinders to activate may be used. The cylinder actuator module 120 selectively activates and deactivates the valves of cylinders based on the target number 282.

The cylinder control module 280 may also instruct a fuel control module 284 to stop providing fuel for deactivated cylinders and may instruct the spark control module 276 to stop providing spark for deactivated cylinders. The spark control module 276 may stop providing spark to a cylinder once an fuel/air mixture that is already present in the cylinder has been combusted.

The fuel control module 284 may vary the amount of fuel provided to each cylinder based on the fuel torque request 274. More specifically, the fuel control module 284 may generate target fueling parameters 286 based on the fuel torque request 274. The target fueling parameters 286 may include, for example, target mass of fuel, target injection starting timing, and target number of fuel injections.

Figure 3:
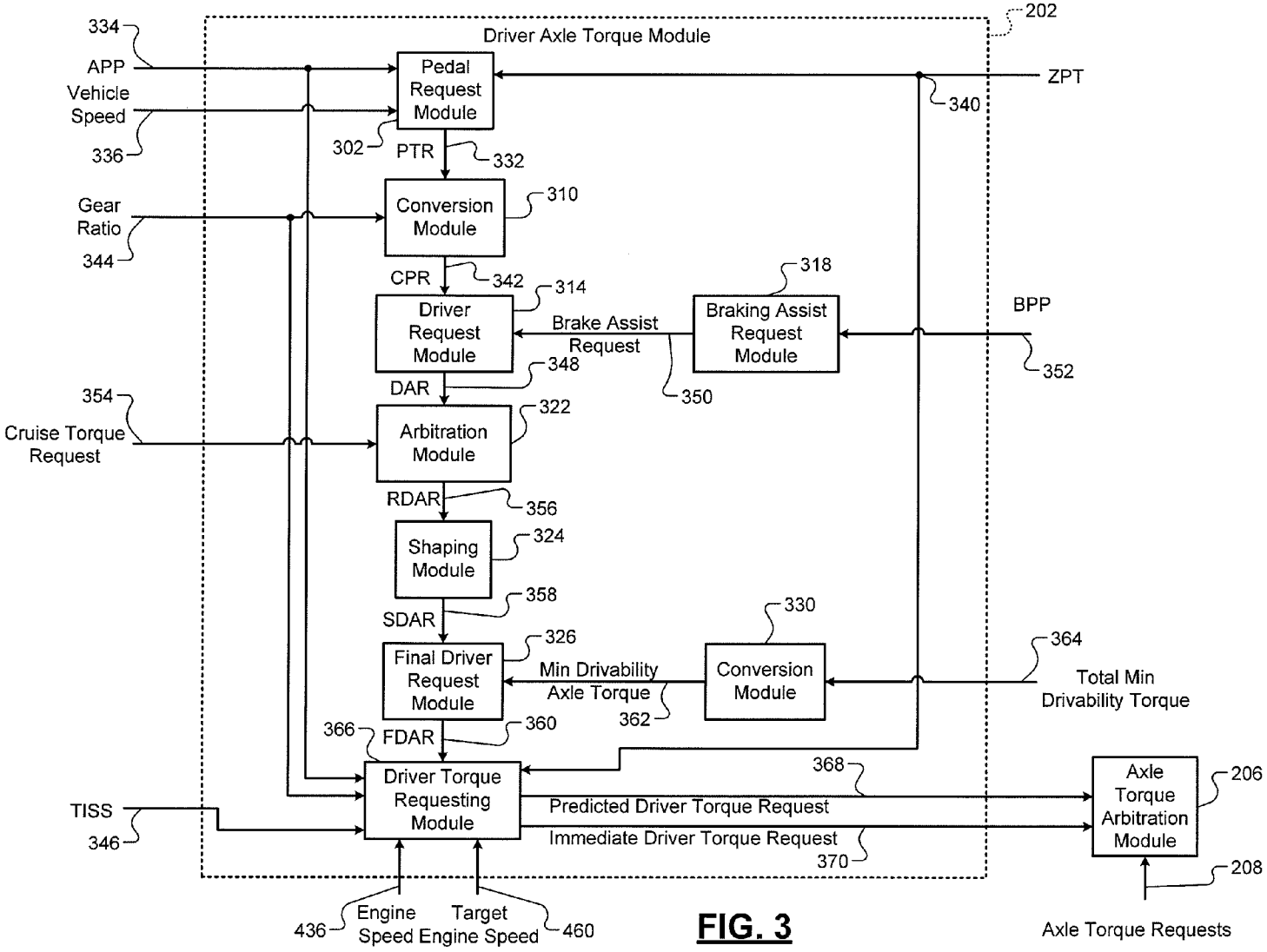
FIG. 3 is a functional block diagram of an example implementation of a driver axle torque module according to the present disclosure.

Referring now to FIG. 3, a functional block diagram of an example implementation of the driver axle torque module 202 is presented. The driver axle torque module 202 may include a pedal request module 302, a conversion module 310, and a driver request module 314. The driver axle torque module 202 may also include a braking assist request module 318, an arbitration module 322, a shaping module 324, a final driver request module 326, and a conversion module 330.

The pedal request module 302 determines a pedal torque request (PTR) 332. The PTR 332 may be generated in the propulsion torque domain, that is, in terms of torque at the crankshaft. In other words, the PTR 332 may be a propulsion torque request. The pedal request module 302 may determine the PTR 332 based on an APP 334, a vehicle speed 336, a zero pedal torque (ZPT) 340, ambient air conditions (e.g., pressure and/or temperature), and/or one or more other suitable parameters. The APP 334 may be, for example, measured using one or more APP sensors. The vehicle speed 336 may be measured, for example, using the vehicle speed sensor 180 or obtained in another suitable manner. The ZPT 340 may refer to a minimum amount of torque that the engine 102 can produce without stalling under the current operating conditions.

The conversion module 310 converts the PTR 332 into the axle torque domain (that is, in terms of torque at the wheels or axles) to produce a converted pedal request (CPR) 342. In other words, the CPR 342 may be an axle torque request. The conversion module 310 may convert the PTR 332 based on, for example, drivetrain losses, a gear ratio 344, one or more torque ratios, and/or one or more other suitable parameters. The gear ratio 344 may refer to a total (speed) ratio provided by the transmission and other driveline components. For example, the gear ratio 344 may correspond to a ratio of a TISS (transmission input shaft speed) 346 to a speed of one or more driveshafts.

The driver request module 314 determines a driver axle request (DAR) 348 based on the CPR 342. The DAR 348 is in the axle torque domain. The driver request module 314 may determine the DAR 348 further based on a braking assist torque request 350. For example only, the driver request module 314 may determine the DAR 348 using the equation:

$$DAR=CPR-BAR,$$

where DAR is the DAR 348 (e.g., Nm), CPR is the CPR 342 (e.g., Nm), and BAR is the braking assist torque request 350 (e.g., Nm).

The braking assist request module 318 may determine the braking assist torque request 350 and provide the braking assist torque request to the driver request module 314. The braking assist torque request 350 may refer to a decrease in the engine output torque attributable to regenerative braking by the electric motor 198 requested to assist the mechanical brakes of the vehicle during vehicle braking. Performing regenerative braking generates electrical power and allows a reduced amount of mechanical braking to be used. The braking assist request module 318 may determine the braking assist request based on a BPP 352. The hybrid control module 196 or the hybrid optimization module 216 may control regenerative braking performed by the electric motor 198 based on the braking assist torque request 350. The BPP 352 may be, for example, measured using one or more BPP sensors.

The arbitration module 322 receives the DAR 348 and other driver torque requests and arbitrates between the received requests. For example only, the arbitration module 322 may arbitrate between the DAR 348 and a cruise torque request 354. The cruise torque request 354 may correspond to a torque request generates by a cruise control system. The cruise control system may generate the cruse torque request 354, for example, to adjust the vehicle speed 336 toward a target vehicle speed. The arbitration module 322 outputs the winner of the arbitration as a raw driver axle request (RDAR) 356 (e.g., Nm). The RDAR 356 is in the axle torque domain.

The shaping module 324 selectively shapes the RDAR 356 to produce a shaped driver axle request (SDAR) 358. For example only, the shaping module 324 may apply one or more filters to the RDAR 356 to generate the SDAR 358. The SDAR 358 is in the axle torque domain.

The final driver request module 326 generates a final driver axle request (FDAR) 360 based on the SDAR 358. The final driver request module 326 may selectively limit the FDAR 360 to a minimum drivability axle torque 362. In other words, the final driver request module 326 may set the FDAR 360 equal to the SDAR 358 when the SDAR 358 is greater than the minimum drivability axle torque 362. When the SDAR 358 is less than the minimum drivability axle torque 362, the final driver request module 326 may set the FDAR 360 equal to the minimum drivability axle torque 362. The minimum drivability axle torque 362 may correspond to a minimum amount of axle torque selected to maintain vehicle drivability (e.g., prevent engine stalling).

The conversion module 330 may determine the minimum drivability axle torque 362 based on a total minimum drivability torque 364. More specifically, the conversion module 330 may convert the total minimum drivability torque 364 from the propulsion torque domain into the axle torque domain to produce the minimum drivability axle torque 362. The conversion may be similar or identical to the conversion performed by the conversion module 310. The total minimum drivability torque may refer to an amount of torque (e.g., Nm) at the crankshaft selected to maintain the vehicle drivability.

A driver torque requesting module 366 generates predicted and immediate driver torque requests 368 and 370 (collectively illustrated in FIG. 2 by reference numeral 204). The predicted and immediate driver torque requests 368 and 370 are provided to the axle torque arbitration module 206 for arbitration with the other axle torque requests, as discussed above. Generation of the predicted and immediate driver torque requests 368 and 370 is discussed further below.

Figure 4:
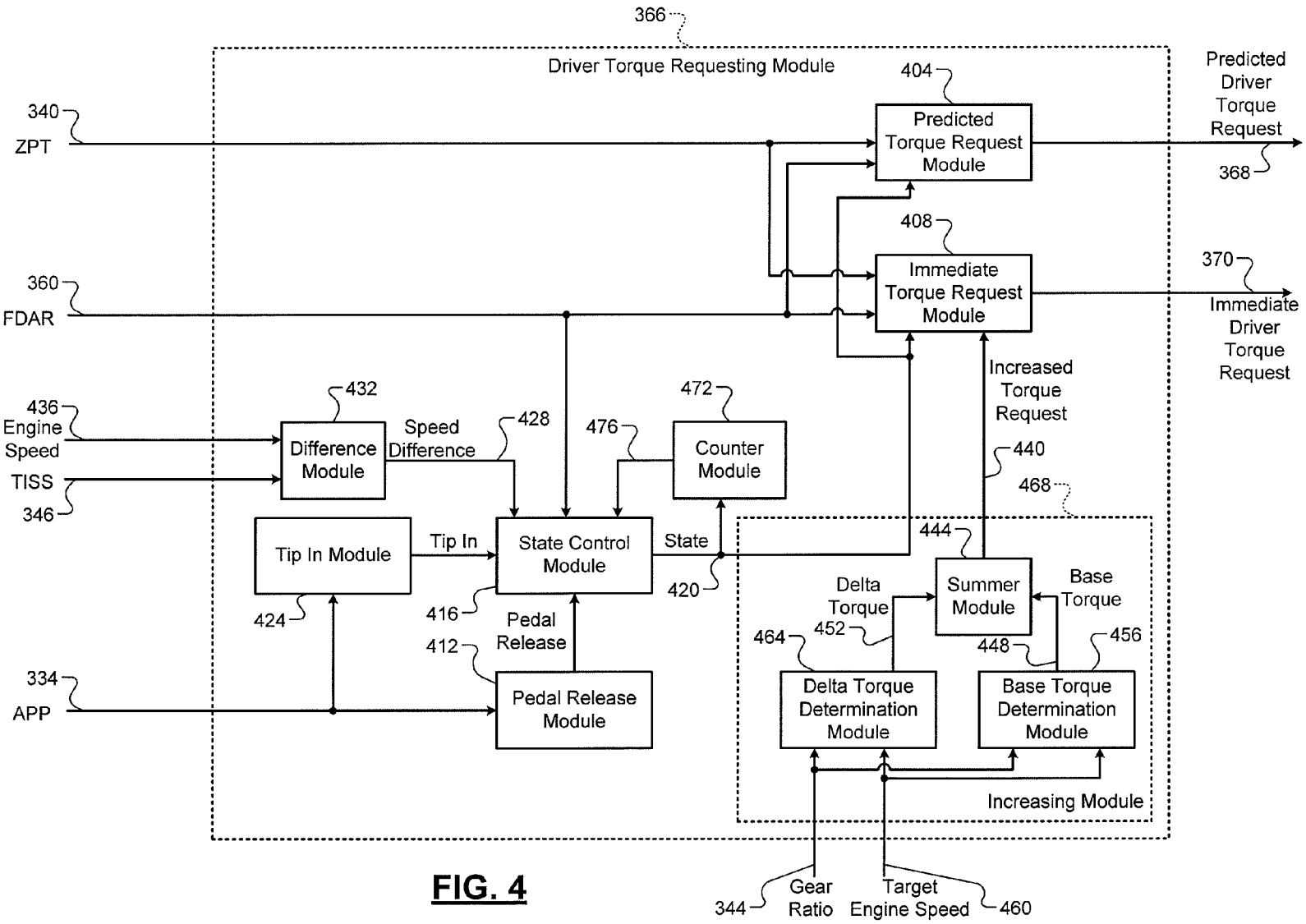
FIG. 4 is a functional block diagram of an example driver torque requesting module according to the present disclosure.

Referring now to FIG. 4, a functional block diagram of an example implementation of the driver torque requesting module 366 is presented. A predicted torque request module 404 generates the predicted driver torque request 368. An immediate torque request module 408 generates the immediate driver torque request 370.

Generally, the predicted and immediate torque request modules 404 and 408 generate the predicted and immediate driver torque requests 368 and 370 based on the FDAR 360. However, when the driver releases the accelerator pedal, the driver may experience sound and/or vibration. The sound and/or vibration may occur when teeth of meshed gears (e.g., of the transmission and/or other driveline components) contact each other after the driver releases the accelerator pedal and the vehicle's momentum is fed back to the engine 102 via the transmission and other driveline components. The driver releasing the accelerator pedal may also be referred to as a tip out event.

To minimize or prevent sound and/or vibration from occurring after the driver releases the accelerator pedal, the predicted and immediate driver torque requests 368 and 370 could be decreased to the ZPT 340 at a rate that is slow enough to prevent or minimize sound and/or vibration. While slowly decreasing the predicted and immediate driver torque requests 368 and 370 may effectively minimize or prevent sound and/or vibration, the predicted and/or immediate driver torque requests 368 and 370 may be decreased to the ZPT 340 more quickly while still minimizing sound and/or vibration.

The immediate torque request module 408 therefore more quickly decreases the immediate driver torque request 370 after the driver releases the accelerator pedal. When a difference between an engine speed and a TISS is negative after the driver releases the accelerator pedal, the immediate torque request module 408 increases the immediate driver torque request 370. The difference being negative indicates that teeth of meshed gears may contact each other and, therefore, that sound and/or vibration may occur.

Increasing the immediate driver torque request 370 causes an increase in the engine torque output (for example via adjusting spark timing, fueling, and/or one or more other fast actuators), thereby increasing the engine speed toward the TISS. Increasing the engine speed toward the TISS decreases may minimize or prevent sound and/or vibration from occurring.

A pedal release module 412 indicates when the driver has released the accelerator pedal based on the APP 334. For example, the pedal release module 412 may indicate that the driver has released the accelerator pedal when the APP 334 is less than a first predetermined position. For example only, the first predetermined position may be approximately 5 percent actuated from a resting (non-actuated) APP or another suitable position. Additionally or alternatively, the pedal release module 412 may indicate that the driver has released the accelerator pedal when a decrease in the APP 334 is greater than a predetermined amount, such as approximately 20-30 percent or another suitable amount.

A state control module 416 transitions a state signal 420 from an initial state to a first state when the pedal release module 412 indicates that the driver has released the accelerator pedal. The state control module 416 may alternatively transition the state signal 420 from the initial state to the first state when the FDAR 360 is less than a predetermined torque (e.g., 0 Newton meters or less) or decreases by at least a predetermined amount (e.g., approximately 50-60 Newton meters). The state control module 416 may require that the driver actuate the accelerator pedal before allowing the state signal 420 to be transitioned to the first state.

A tip in module 424 may indicate that the driver has actuated the accelerator pedal based on the APP 334. For example, the tip in module 424 may indicate that the driver has actuated the accelerator pedal when the APP 334 is greater than a second predetermined position. The second predetermined position may be greater than or equal to the first predetermined position.

When the state signal 420 is in the initial state, the predicted and immediate torque request modules 404 and 408 may set the predicted and immediate driver torque requests 368 and 370, respectively, based on the FDAR 360. When the state signal 420 is in the first state, the predicted and immediate torque request modules 404 and 408 decrease the predicted and immediate driver torque requests 368 and 370 toward the ZPT 340. The predicted and immediate torque request modules 404 and 408 may decrease the predicted and immediate driver torque requests 368 and 370, respectively, at the same or different rates. Decreasing the predicted and immediate driver torque requests 368 decreases the amount of torque produced by the engine 102 as requested by the driver via releasing the accelerator pedal. The rates at which the predicted and immediate torque request modules 404 and 408 decrease the predicted and immediate driver torque requests 368 and 370 may be fixed or variable values.

The state control module 416 monitors a speed difference 428 while the state signal 420 is in the first state. A difference module 432 may set the speed difference 428 based on a difference between an engine speed 436 and the TISS 346. For example, the difference module 432 may set the speed difference 428 equal to the engine speed 436 minus the TISS 346. The engine speed 436 may be measured using the crankshaft position sensor 178. The TISS 346 may be measured using the TISS sensor 188. The speed difference 428 may also be referred to as a slip value.

When the speed difference 428 is less than a predetermined negative speed and the state signal 420 is in the first state, the state control module 416 may transition the state signal 420 from the first state to a second state. The predetermined negative speed is negative and may be, for example, approximately −100 RPM or another suitable negative speed. The speed difference 428 becoming less than the predetermined negative speed after the driver releases the accelerator pedal may indicate that sound and/or vibration may occur.

If a predetermined period passes after the predicted and immediate torque request modules 404 and 408 begin decreasing the predicted and immediate driver torque requests 368 and 370 and the speed difference 428 does not become less than the predetermined negative speed, the state control module 416 may transition the state signal 420 back to the initial state. Sound and/or vibration may not occur when the speed difference 428 does not become less than the predetermined negative speed within the predetermined period after the driver releases the accelerator pedal. The predetermined period may be, for example, approximately 0.5-1.0 seconds or another suitable period.

When the state signal 420 is in the second state, immediate torque request module 408 increases the immediate driver torque request 370. For example, the immediate torque request module 408 may set the immediate driver torque request 370 to an increased torque request 440 when the state signal 420 is in the second state. The increased torque request 440 is greater than the immediate driver torque request 370 at the time when the state signal 420 is transitioned to the second state. The predicted torque request module 404 may decrease, maintain, or increase the predicted driver torque request 368 when the state signal 420 is in the second state.

A summer module 444 may set the increased torque request 440 based on a base torque 448 and a delta torque 452. For example, the summer module 444 may set the increased torque equal to a sum of the base torque 448 and the delta torque 452. The increased torque request 440 increases the torque output of the engine 102 to increase the engine speed toward the TISS 346 and thereby minimize sound and/or vibration when teeth of gears of the driveline contact each other.

A base torque determination module 456 may determine the base torque 448 based on the gear ratio 344 and a target engine speed 460. The target engine speed 460 may be set to greater than the engine speed 436, such as to or based on the TISS 346, to adjust the speed difference 428 toward zero. The base torque determination module 456 may determine the base torque 448, for example, using one of a mapping and a function that relates the gear ratio 344 and the target engine speed 460 to the base torque 448. The mapping or function used to determine the base torque 448 may be calibrated such that the base torque 448 is greater than the immediate driver torque request 370 would have been had the immediate torque request module 408 continued to decrease the immediate driver torque request 370.

A delta torque determination module 464 may determine the delta torque 452. The delta torque determination module 464 may determine the delta torque 452 based on the gear ratio 344 and a difference between the target engine speed 460 and the engine speed 436. As stated above, the target engine speed 460 may be set to greater than the engine speed 436, such as to or based on the TISS 346, to adjust the speed difference 428 toward zero. The delta torque determination module 464 may determine the delta torque 452, for example, using one of a mapping and a function that relates the gear ratio 344 and the difference between the target engine speed 460 and the engine speed 436 to the delta torque 452.

In various implementations, an increasing module 468 may be implemented and generate the increased torque request 440 based on the gear ratio 344, the target engine speed 460, and the engine speed 436. For example, the increasing module 468 may determine the increased torque request 440, for example, using one of a mapping and a function that relates the gear ratio 344, the target engine speed 460, and the difference between the target engine speed 460 and the engine speed 436 to the increased torque request 440. Under some circumstances, the increasing module 468 may set the increased torque request 440 to a predetermined value. For example only, the increasing module 468 may set the increased torque request 440 to the immediate driver torque request 370 while the state signal 120 is in the first state during a period before the state signal 420 is transitioned to the second state or when the state signal 420 is in the second state.

Setting the immediate driver torque request 370 to the increased torque request 440 when the state signal 420 is in the second state increases the torque output of the engine 102, for example, via adjusting the spark timing and/or fueling. The increased torque output increases the engine speed 436 to toward the TISS 346, thereby minimizing sound and/or vibration that occurs when teeth of meshed gears contact each other.

A counter module 472 may reset a counter value 476 when the state signal 420 transitions to the second state. The counter module 472 may increment the counter value 476 every predetermined period when the state signal 420 is in the second state. In this manner, the counter module 472 tracks the period elapsed since the immediate torque request module 408 started increasing the immediate driver torque request 370. The predetermined period may correspond to a rate at which the modules of the driver torque request module 366 update their outputs, such as approximately 3 milliseconds (ms) or another suitable period. While use of the counter module 472 and the counter value 476 is discussed, a timer and a period may be used alternatively.

When the counter value 476 is greater than a predetermined value, the state control module 416 transitions the state signal 420 from the second state to a third state. The predetermined value corresponds to a predetermined period for increasing torque to minimize sound and/or vibration and may be, for example, approximately 60-120 ms or another suitable period.

The predicted and immediate torque request modules 404 and 408 decrease the predicted and immediate driver torque requests 368 and 370 toward the ZPT 340 when the state signal 420 is in the third state. For example, the predicted and immediate torque request modules 404 and 408 may decrease the predicted and immediate driver torque requests 368 and 370 exponentially beginning when the state signal is transitioned to the third state. Decreasing the predicted and immediate driver torque requests 368 and 370 at faster rates may enable one or more fuel savings actions (e.g., fuel cutoff, deceleration fuel cutoff, and/or cylinder deactivation) to be taken sooner than if the predicted and immediate driver torque requests 368 and 370 were decreased at rates that are slow enough to prevent or minimize sound and/or vibration.

Figure 5:
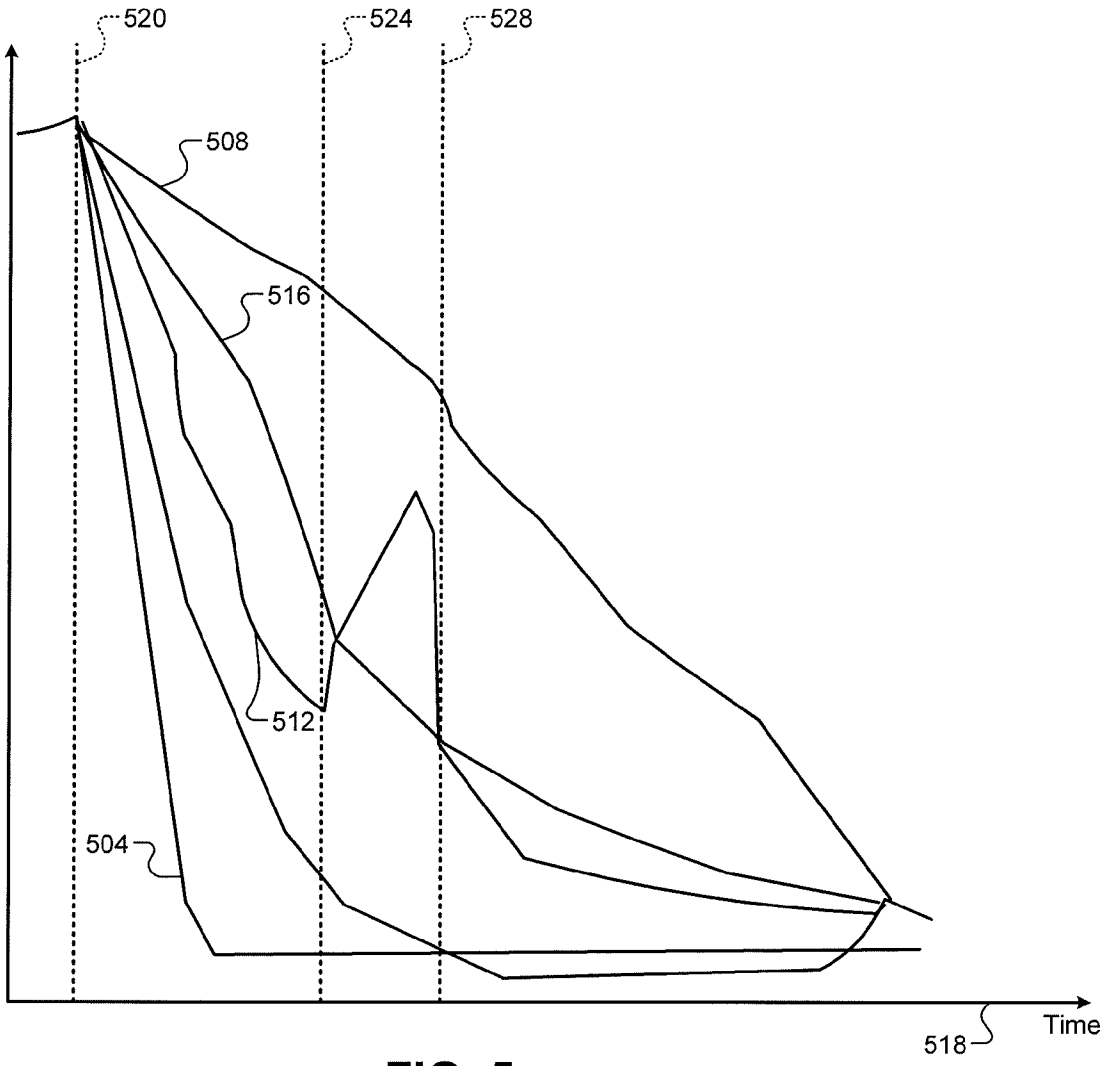
FIG. 5 is an example graph of accelerator pedal position and various torque requests as functions of time.

FIG. 5 includes an example graph of an accelerator pedal position 504, an example predicted driver torque request 508, an example immediate driver torque request 512, and a purely decreased immediate driver torque request 516 as functions of time 518. The driver releases the accelerator pedal at approximately time 520, and the accelerator pedal position 504 therefore decreases.

The predicted and immediate torque request modules 404 and 408 decrease the predicted and immediate driver torque requests 368 and 370, respectively, after the driver releases the accelerator pedal. The purely decreasing immediate torque request 516 could be used to prevent sound and/or vibration from occurring.

The speed difference 428 becomes less than the predetermined negative speed at approximately time 524. The immediate torque request module 408 therefore increases the immediate driver torque request 370 to minimize sound and/or vibration. The example immediate driver torque request 512 includes an example of such an increase after time 524.

The immediate torque request module 408 may increase the immediate driver torque request 370 for the predetermined period (e.g., approximately 60-120 ms) after the speed difference 428 becomes less than the predetermined negative speed. The predetermined period may end at approximately time 528. The immediate torque request module 408 may begin decreasing the immediate driver torque request 370 more rapidly, such as based on a predetermined exponential decrease. The example immediate driver torque request 512 includes an example exponential decrease after time 528.

Figure 6:
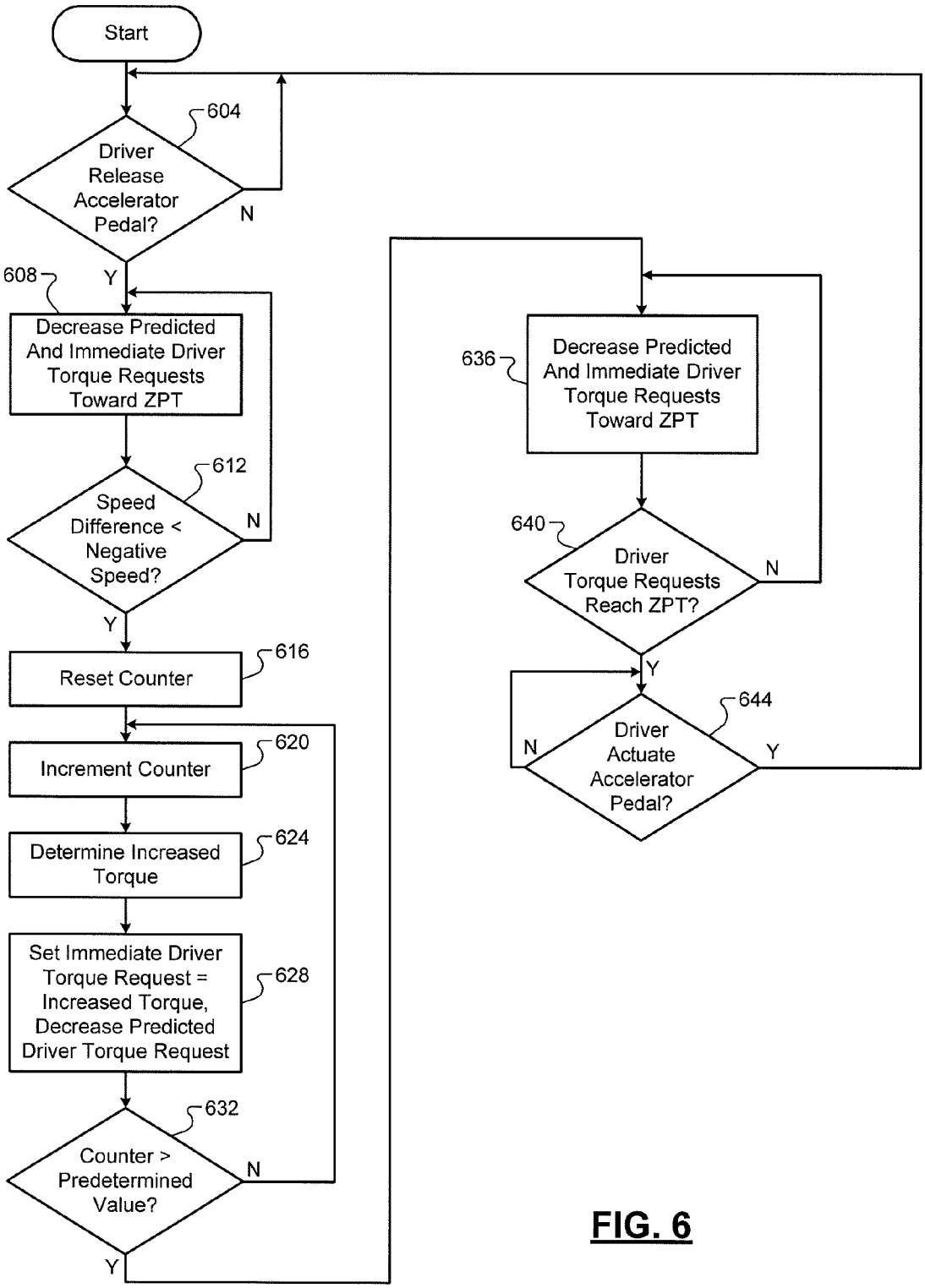
FIG. 6 is a flowchart depicting an example method of controlling immediate and predicted driver torque requests when a driver releases an accelerator pedal according to the present disclosure.

Referring now to FIG. 6, a flowchart depicting an example method of setting the predicted and immediate driver torque requests 368 and 370 when the driver releases the accelerator pedal is presented. Control may begin with 604 where the pedal release module 412 determines whether the driver has released the accelerator pedal. If 604 is true, control continues with 608. If 604 is false, control may remain at 604. The pedal release module 412 may determine that the driver has released the accelerator pedal, for example, when the APP 334 is less than a predetermined position or the APP 334 decreases by more than a predetermined amount.

At 608, the predicted and immediate torque request modules 404 and 408 decrease the predicted and immediate driver torque requests 368 and 370, respectively, toward the ZPT 340. The predicted and immediate torque request modules 404 and 408 may decrease the predicted and immediate driver torque requests 368 and 370, respectively, at the same or different rates.

At 612, the state control module 416 determines whether the speed difference 428 is less than the predetermined negative speed. If 612 is true, control continues with 616. If 612 is false, control may return to 608 to continue decreasing the predicted and immediate driver torque requests 368 and 370. The predetermined speed may be, for example, approximately −100 RPM or another suitable speed that indicates that sound and/or vibration may occur. If the speed difference 428 does not become less than the predetermined negative speed within a predetermined period (e.g., approximately 0.5-1.0 seconds) after the driver releases the accelerator pedal, the predicted and immediate torque request modules 404 and 408 may continue decreasing the predicted and immediate driver torque requests 368 and 370 toward the ZPT 340 and control may transfer to 644, which is discussed further below.

The counter module 472 resets the counter value 476 at 616 and increments the counter value 476 at 620. At 624, the increasing module 468 may determine the increased torque request 440 based on the gear ratio 344 and the target engine speed 460. For example, the base and delta torque determination modules 456 and 464 may determine the base and delta torques 448 and 452 based on the gear ratio, the target engine speed 460, and/or the difference between the target engine speed 460 and the engine speed 436, and the summer module 444 may set the increased torque request 440 to a sum of the base and delta torques 448 and 452. The predicted torque request module 404 may decrease, maintain, or increase the predicted driver torque request 368 at 628.

At 632, the state control module 416 determines whether the counter value 476 is greater than a predetermined value. The predetermined value corresponds to a predetermined period, such as approximately 60-120 ms or another suitable predetermined period. If 632 is true, control continues with 636. If 632 is false, control returns to 620 to continue using the increased torque request 440.

The predicted and immediate torque request modules 404 and 408 decrease the predicted and immediate driver torque requests 368 and 370, respectively, toward the ZPT 340 at 636. Decreases in the predicted and immediate driver torque requests 368 and 370 made at 636 may be made such that the predicted and immediate driver torque requests 368 and 370 are decreased based on a predetermined exponential curve over time. Decreasing the predicted and immediate driver torque requests 368 and 370 exponentially may enable one or more fuel savings actions to be taken sooner, such as fuel cutoff, deceleration fuel cutoff, and/or cylinder deactivation.

At 640, the state control module 416 may determine whether the predicted and immediate driver torque requests 368 and 370 are approximately equal to the ZPT 340. If 640 is true, control may continue with 644. If 640 is false, control may return to 636 to continue decreasing the predicted and immediate driver torque requests 368 and 370 toward the ZPT 340. At 644, the state control module 416 may determine whether the driver has actuated the accelerator pedal. If 644 is true, control may return to 604 to wait for another tip out event. If 644 is false, control may remain at 644. While determination of whether the driver has actuated the accelerator pedal at 644 is shown, if the driver actuates the accelerator pedal between 608 and 640, control may also return to 604.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. An engine control system of a vehicle, comprising:

a difference module that determines a difference between an engine speed and a transmission input shaft speed;

a state control module that sets a signal to a first state when a driver releases an accelerator pedal and that selectively transitions the signal from the first state to a second state when the difference is less than zero;

an immediate torque request module that decreases an engine torque request when the signal is in the first state and that selectively increases the engine torque request when the signal is in the second state; and at least one of:

a spark control module that selectively adjusts spark timing based on the engine torque request; and a fuel control module that selectively adjusts fueling based on the engine torque request.

2. The engine control system of claim 1 wherein the difference module sets the difference equal to the engine speed minus the transmission input shaft speed.

3. The engine control system of claim 1 wherein at least one of:

the spark control module advances the spark timing when the engine torque request increases; and the fuel control module increases fueling when the engine torque request increases.

4. The engine control system of claim 1 wherein:

the state control module transitions the signal from the second state to a third state a predetermined period after transitioning the signal to the second state; and the immediate torque request module decreases the engine torque request when the signal is in the third state.

5. The engine control system of claim 4 wherein the immediate torque request module decreases the engine torque request exponentially when the signal is in the third state.

6. The engine control system of claim 4 wherein the immediate torque request module decreases the engine torque request at a first rate when the signal is in the first state and decreases the engine torque request at a second rate when the signal is in the third state.

7. The engine control system of claim 1 further comprising an increasing module that determines an increased torque request based on a gear ratio and a target engine speed, wherein the immediate torque request module sets the engine torque request to the increased torque request when the signal is in the second state.

8. The engine control system of claim 7 wherein the increasing module determines a base torque based on the gear ratio and the target engine speed, determines a delta torque based on the gear ratio and a difference between the target engine speed and the engine speed, and determines the increased torque request based on the base torque and the delta torque.

9. The engine control system of claim 8 wherein the increasing module sets the increased torque equal to the base torque plus the delta torque.

10. The engine control system of claim 1 wherein the state control module selectively transitions the signal from the first state to the second state when the difference is less than a predetermined speed that is less than zero.

11. An engine control method for a vehicle, comprising:

determining a difference between an engine speed and a transmission input shaft speed;

setting a signal to a first state when a driver releases an accelerator pedal;

selectively transitioning the signal from the first state to a second state when the difference is less than zero;

decreasing an engine torque request when the signal is in the first state;

selectively increasing the engine torque request when the signal is in the second state; and at least one of:

selectively adjusting spark timing based on the engine torque request; and selectively adjusting fueling based on the engine torque request.

12. The engine control method of claim 11 further comprising setting the difference equal to the engine speed minus the transmission input shaft speed.

13. The engine control method of claim 11 further comprising at least one of:

advancing the spark timing when the engine torque request increases; and increasing fueling when the engine torque request increases.

14. The engine control method of claim 11 further comprising:

transitioning the signal from the second state to a third state a predetermined period after transitioning the signal to the second state; and decreasing the engine torque request when the signal is in the third state.

15. The engine control method of claim 14 further comprising decreasing the engine torque request exponentially when the signal is in the third state.

16. The engine control method of claim 14 further comprising:

decreasing the engine torque request at a first rate when the signal is in the first state; and decreasing the engine torque request at a second rate when the signal is in the third state.

17. The engine control method of claim 11 further comprising:

determining an increased torque request based on a gear ratio and a target engine speed; and setting the engine torque request to the increased torque request when the signal is in the second state.

18. The engine control method of claim 17 further comprising:

determining a base torque based on the gear ratio and the target engine speed;

determining a delta torque based on the gear ratio and a difference between the target engine speed and the engine speed; and determining the increased torque request based on the base torque and the delta torque.

19. The engine control method of claim 18 further comprising setting the increased torque equal to the base torque plus the delta torque.

20. The engine control method of claim 11 further comprising selectively transitioning the signal from the first state to the second state when the difference is less than a predetermined speed that is less than zero.

* * * * *